US010992037B2

(12) United States Patent
Rogers et al.

(10) Patent No.: US 10,992,037 B2
(45) Date of Patent: Apr. 27, 2021

(54) STEERABLE ANTENNA ASSEMBLY

(71) Applicant: THE BOEING COMPANY, Chicago, IL (US)

(72) Inventors: John E. Rogers, Huntsville, AL (US); Corey M. Thacker, Madison, AL (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/574,126

(22) Filed: Sep. 18, 2019

(65) Prior Publication Data

US 2021/0083376 A1 Mar. 18, 2021

(51) Int. Cl.

| | |
|---|---|
| ***H01Q 1/38*** | (2006.01) |
| ***H01Q 3/24*** | (2006.01) |
| ***H01Q 21/00*** | (2006.01) |
| ***H01Q 15/08*** | (2006.01) |
| ***H01Q 1/48*** | (2006.01) |

(52) U.S. Cl.

CPC ..... *H01Q 3/24* (2013.01); *H01Q 1/38* (2013.01); *H01Q 1/48* (2013.01); *H01Q 15/08* (2013.01); *H01Q 21/0075* (2013.01); *H01Q 21/0087* (2013.01)

(58) Field of Classification Search

CPC ..... H01Q 3/24; H01Q 3/242; H01Q 3/245; H01Q 3/247; H01Q 3/443; H01Q 5/00; H01Q 11/00; H01Q 13/00; H01Q 13/0208; H01Q 13/0241; H01Q 15/242; H01Q 15/244; H01Q 15/248; H01Q 17/00; H01Q 19/00

See application file for complete search history.

(56) References Cited

U.S. PATENT DOCUMENTS

| | | | | |
|---|---|---|---|---|
| 49,620 A * | 8/1865 | Frick | G01N 21/255 402/69 |
| 92,220 A * | 7/1869 | Speer | H01Q 7/00 343/702 |
| 351,988 A * | 11/1886 | Lord | H01P 5/08 239/687 |
| 5,165,109 A * | 11/1992 | Han | H01Q 9/0435 343/700 MS |

(Continued)

FOREIGN PATENT DOCUMENTS

WO WO-9815033 A1 * 4/1998 ..... H01Q 19/062

OTHER PUBLICATIONS

Fonseca, M. A., et al., "Flexible wireless passive pressure sensors for biomedical applications," Hilton Head 2006, Jun. 2006.

(Continued)

*Primary Examiner* — Graham P Smith

(74) *Attorney, Agent, or Firm* — The Small Patent Law Group LLC; Joseph M. Butscher

(57) ABSTRACT

An antenna assembly includes a composite substrate. One or more first antenna elements are secured to the composite substrate. A microstrip feed network is secured to the composite substrate. The first antenna elements are electrically coupled to the microstrip feed network. A switch is electrically connected to the microstrip feed network. The switch is configured to selectively control the first antenna element(s). A dielectric lens may be disposed on the composite substrate over the first antenna element(s).

20 Claims, 5 Drawing Sheets

(56) References Cited

U.S. PATENT DOCUMENTS 9,772,422 B2 9/2017 Hull
10,291,312 B2 5/2019 Savage

OTHER PUBLICATIONS

Abad, E., et al., "Flexible tag microlab development: gas sensors integration in RFID flexible tags for food logistics," Sensors and Actuators B, Jul. 2007.
Rida, A., et al., "Conductive inkjet-printed antennas on flexible low-cost paper-based substrates for RFID and WSN applications," IEEE Antennas and Propagation Magazine, Jun. 2009.
Schwerdt, H. N., et al., "A fully passive wireless microsystem for recording of neuropotentials using RF backscattering methods," Journal of Microelectromechanical Systems, Aug. 2011.
Rose, D. P., et al., "Adhesive RFID sensor patch for monitoring of sweat electrolytes," IEEE Transactions on Biomedical Engineering, Jun. 2015.
Bilo, J., et al., "Ambient RF energy harvesting from a two-way talk radio for flexible wearable wireless sensor devices utilizing inkjet printing technologies," IEEE Transactions on Microwave Theory and Techniques, Dec. 2015.
Escobedo, P., et aL, "Flexible passive near field communication tag for multigas sensing," Analytical chemistry, Dec. 2016.
Xu, G., et al., "Passive and wireless near field communication tag sensors for biochemical sensing with smartphone," Sensors and Actuators B, Feb. 2017.
Pozar, D.M., "Microstrip antenna aperture-coupled to a microstrip line," Electronics Letters, Jan. 1985.
Pozar, D.M., Kaufman, B., "Increasing the bandwidth of a microstrip antenna by proximity coupling," Electronics Letters, Apr. 1987.
Hallil, H., et al., "Feasibility of wireless gas detection with an FMCW RADAR interrogation of passive RF gas sensor," IEEE Sensors, Nov. 2010.
Iwasaki, H., "A circularly polarized small-size microstrip antenna with a cross slot," IEEE Transactions on Antennas and Propagation, Oct. 1996.
Papapolymerou, I., et al., "Micromachined patch antennas," IEEE Transactions on Antennas and Propagation, Feb. 1998.
Gauthier, G.P., et al., "A 94 GHz aperture-coupled micromachined microstrip antenna," IEEE Transactions on Antennas and Propagation, Dec. 1999.
Cook, B.S., et al., "Multilayer inkjet printing of millimeter-wave proximity-fed patch arrays on flexible substrates," IEEE Antennas and Wireless Propagation Letters, Oct. 2013.
Sorkherizi, M.S., et al., "Planar high-efficiency antenna array using new printed ridge gap waveguide technology," IEEE Transactions on Antennas and Propagation, Jul. 2017.
Yi, X., et al., "Passive wireless smart-skin sensor using RFID-based folded patch antennas," International Journal of Smart and Nano Materials, Mar. 2011.
Zhang, N., et al., "Temperature sensor based on 4H-silicon carbide pn diode operational from 20C to 600C," Applied Physics Letters, Feb. 2014.
Rogers, J.E., et al., "A passive wireless microelectromechanical pressure sensor for harsh anvironments," Journal of Microelectromechanical Systems, Feb. 2018.
Pozar, Voda, "A rigorous analysis of a microstripline fed path antenna," IEEE Transations on Antennas and Propagation, Dec. 1987.
Davidovitz, M., Lo, Y.T. "Rigorous analysis of a circular patch antenna excited by a microstrip transmission line," IEEE Transactions on Antennas and Propagation, Aug. 1989.
Patterson, C.E, et al. "A lightweight X-band organic antenna array with integrated SiGe amplifier," IEEE Radio and wireless Symposium 2010, Jan. 2010.
Patterson, C.E, et al "Implementation of a low cost, lightweight X-band antenna with integrated SiGe RF electronics," IEEE Geoscience and Remote Sensing Symposium 2010, Jul. 2010.
Morcillo, C.A.D., et al. "An ultra-thin, high-power, and multilayer organic antenna array with T/R functionality in the X-band," IEEE Transactions on Microwave Theory and Techniques, Dec. 2012.
Stephen Horst, et al., "Beam-Shaping of Planar Array Antennas Using Integrated Attenuators", 2007 Electronic Components and Technology Conference, pp. 165-168.
Uehara, K., et al., "Lens-coupled imaging arrays for the millimeter- and submillimeter-wave regions," IEEE Transactions on Microwave Theory and Techniques, May 1992.
Raman, S., et al, "A W-band dielectric-lens-based integrated monopulse radar receiver," IEEE Transactions on Microwave Theory and Techniques, Dec. 1998.
Wu, X., et al, "Design and characterization of single- and multiple-beam mm-wave circularly polarized substrate lens antennas for wireless communications," IEEE Transactions on Microwave Theory and Techniques, Mar. 2001.
Mall, L., Waterhouse, R. B., "Millimeter-wave proximity-coupled microstrip antenna on an extended hemispherical dielectric lens," IEEE Transactions on Antennas and Propagation, Dec. 2001.
Zhang, G.H., et al., "A circular waveguide antenna using high-impedance ground plane," IEEE Antennas and Wireless Propagation Letters, 2003.
Li, B., et al., "Study on high gain circular waveguide array antenna with metamaterial structure," Progress in Electromagnetics Research, 2006.
Cheng, Y.J., et al, "W-band large-scale high-gain planar integrated antenna array," IEEE Transactions on Antennas and Propagation, Jun. 2014.
Rida, A., et al., "Proximity coupled fed antenna arrays on LCP for mm-wave applications," IEEE Antennas and Propagation Society International Symposium, Jul. 2010.
Yi, J., et al., "Restoring in-phase emissions from non-planar radiating elements using a transformation optics based lens," Applied Physics Letters, Jul. 2015.

* cited by examiner

STEERABLE ANTENNA ASSEMBLY

FIELD OF EMBODIMENTS OF THE DISCLOSURE

Embodiments of the present disclosure generally relate to antenna assemblies, and more particularly, to antenna assemblies having steerable antenna arrays.

BACKGROUND OF THE DISCLOSURE

An integrated antenna typically includes an array of antenna elements electrically connected to an electronic receiver or a transmitter. An electronic transmitter provides a time-varying voltage to terminals of the antenna, which, in response, radiates electromagnetic radio waves at a frequency corresponding to the time-varying voltage. Alternatively, as radio waves are received by the antenna, a time-varying voltage corresponding to the frequency of the radio wave is generated at the terminals, which, in turn is provided to the electronic receiver. Various types of known passive antennas are configured to transmit and receive radio waves with such a reciprocal behavior.

In some aerospace applications, there is a need for antennas that are capable of being positioned on conformal or non-planar surfaces, such as wings and fuselages of aircraft. Small aircraft, such as unmanned aerial vehicles (UAVs) or drones, in particular, have surfaces with low radii of curvature. Such aircraft typically need light weight antennas with low aerodynamic drag and low visibility. Further, various surfaces of aircraft may be formed from conductive or carbon fiber materials, which are known to change the electrical behavior of antennas, such as monopole and dipole antennas and derivatives (for example, whip, blade, Yagi, and other such antennas).

In certain radar and imaging applications, for example, antenna arrays are configured to steer energy in desired directions. In such steerable antenna assemblies, each antenna element is typically electrically connected to a respective amplifier and a phase shifter. Known active electronically steerable antennas allow for magnitude and/or phase-shifting ability for each antenna element.

However, such antenna assemblies consume relatively high power, due to each element being electrically connected to respective electronics (such as amplifiers and phase shifters). Moreover, the inclusion of such electronics typically increases the cost of such antenna assemblies.

SUMMARY OF THE DISCLOSURE

A need exists for a steerable antenna assembly that consumes a reduced amount of power. Further, a need exists for a steerable antenna assembly that is less costly to produce than known electronically steerable antennas.

With those needs in mind, certain embodiments of the present disclosure provide an antenna assembly that includes a composite substrate. One or more first antenna elements are secured to the composite substrate. A microstrip feed network is secured to the composite substrate. The first antenna element(s) are electrically coupled to the microstrip feed network. A switch is electrically connected to the microstrip feed network. The switch is configured to selectively control the first antenna element(s).

In at least one embodiment, a dielectric lens is disposed on the composite substrate over the first antenna element(s).

The dielectric lens may include a hemispherical dome mounted on a top surface of the composite substrate over the first antenna element(s).

In at least one embodiment, the first antenna element(s) are disposed on a top surface of the composite substrate. The microstrip feed network is embedded within the composite substrate.

The antenna assembly may also include a ground plane secured to a bottom surface of the composite substrate below the one or more first antenna elements. A ground plane may also be secured to a top surface of the composite substrate away from the one or more first antenna elements.

In at least one embodiment, a waveguide is secured to a bottom surface of the composite substrate opposite from the ground plane. One or more second antenna elements are disposed on the bottom surface of the composite substrate within a central channel of the waveguide. One or more microstrip feed lines electrically couple the second antenna element(s) to the switch.

In at least one embodiment, the composite substrate includes a first dielectric (wherein the first antenna element(s) are disposed on a top surface of the first dielectric), a second dielectric, a third dielectric (wherein the microstrip feed network is disposed on the third dielectric, and the first dielectric is separated from third dielectric by the second dielectric), and a fourth dielectric. A dielectric lens is disposed on the top surface of the first dielectric over the first antenna element(s). A first ground plane is disposed on a bottom surface of the fourth dielectric below the first antenna element(s). A second ground plane may be disposed on the top surface of the first dielectric away from the first antenna element(s). One or more electrical vias may extend through the composite substrate and electrically connect the first ground plane to the second ground plane. One or more second antenna elements may be disposed on the bottom surface of the fourth dielectric away from the first ground plane and below the second ground plane. A waveguide may be disposed on the bottom surface of the fourth dielectric. The second antenna element(s) may be within a central channel of the waveguide.

Certain embodiments of the present disclosure provide a method that includes securing one or more first antenna elements to a composite substrate, securing a microstrip feed network to the composite substrate, electrically coupling the first antenna element(s) to the microstrip feed network, electrically connecting a switch to the microstrip feed network, and selectively controlling the first antenna element(s) by the switch. The method may also include disposing a dielectric lens on the composite substrate over the first antenna element(s).

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Certain embodiments of the present disclosure provide an antenna assembly that includes one or more antenna elements (such as proximity-coupled antenna elements with inclusive slots), a microstrip feed network (such as may be embedded in a composite substrate), a ground plane on a backside of the composite substrate, a dielectric lens enclosing the antenna element(s), and switches (such as radio frequency (RF) switches) electrically connected to the microstrip feed. The antenna assembly may also include an integrated microstrip-to-waveguide transition. The embedded microstrip feed network electrically couples to the backside ground plane, thereby promoting efficient signal propagation. The backside ground plane minimizes or otherwise reduces change in electrical behavior due to environmental surfaces (for example, conductive surfaces). The lens may be formed through three-dimensional printing, on a surface of the composite substrate, enclosing the antenna element(s). In at least one embodiment, the switches may be disposed on the same layer as the microstrip feed network. The antenna assembly has few, if any, electronic interconnects, thereby reducing fabrication costs. The antenna assembly may be manufactured using a combination of additive (for example, printing or film deposition) and/or subtractive (for example, wet etching, milling, or laser etching) techniques.

Certain embodiments of the present disclosure provide an integrated low-power steerable antenna assembly that includes a dielectric lens enclosing antenna elements, and integrated RF switches to selectively control the antenna elements. The antenna assembly provides a low-cost and low-power system that is able to steer energy in desired directions without the use of extensive electronics. The dielectric lens and integrated RF switches allow the antenna elements to be selectively controlled, thereby allowing for a steerable antenna assembly that consumes less power than known electronically-controlled antenna elements.

Figure 1:
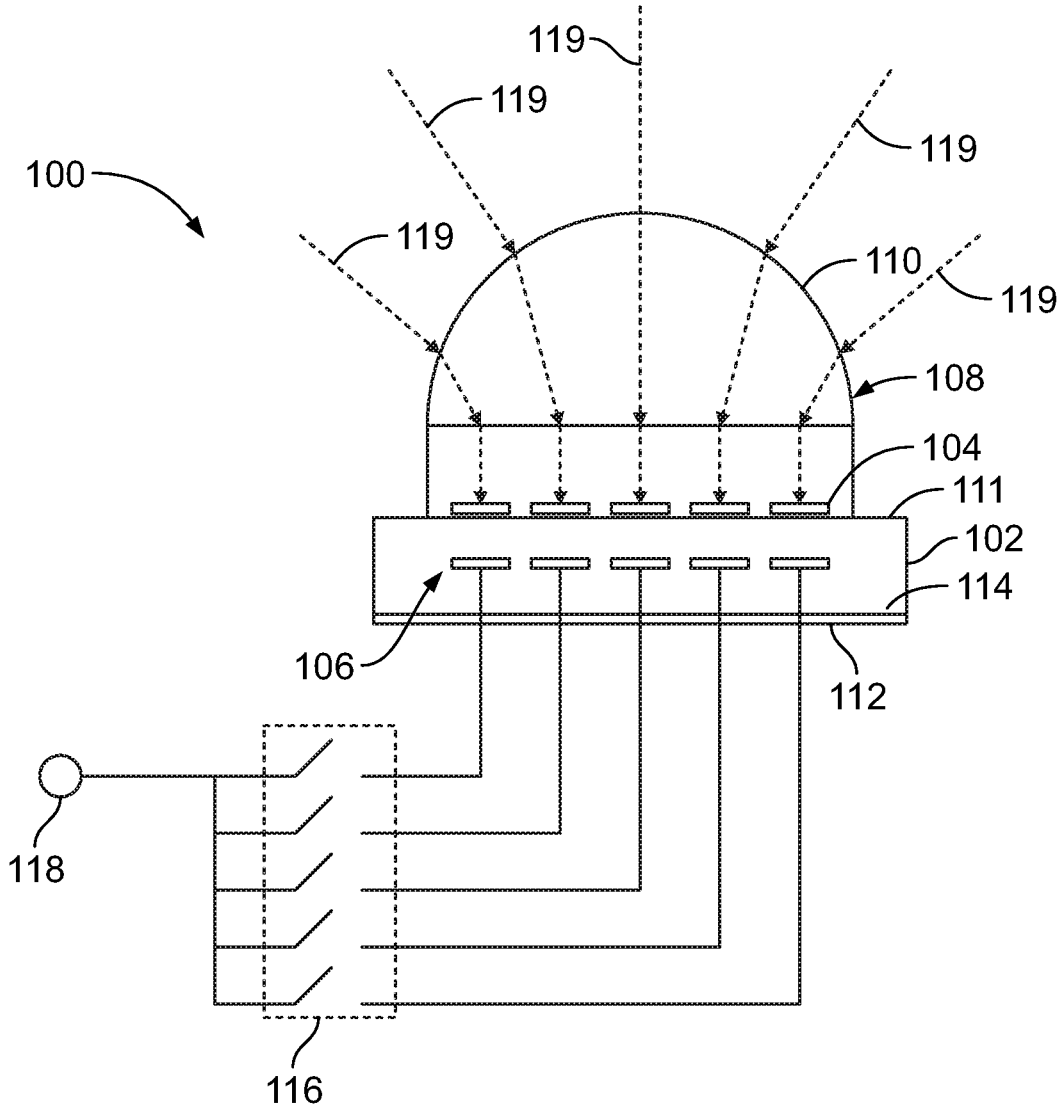
FIG. 1 illustrates a schematic diagram of an antenna assembly, according to an embodiment of the present disclosure.

FIG. 1 illustrates a schematic diagram of an antenna assembly 100, according to an embodiment of the present disclosure. The antenna assembly 100 includes a composite substrate 102 having one or more antenna elements 104 disposed thereon and/or therein. A microstrip feed network 106 is embedded within the composite substrate 102 and is proximity coupled to the antenna elements 104. Optionally, the microstrip feed network 106 and the antenna elements 104 may be on or within a common layer, such that the microstrip feed network 106 is edge-fed in relation to the antenna elements 104. The antenna assembly 100 may include more or less antenna elements 104 than shown.

A dielectric lens 108 is mounted on the composite substrate 102 over the antenna elements 104. The dielectric lens 108 includes a hemispherical dome 110 mounted on a top surface 111 of the composite substrate 102 over the antenna elements 104. The dielectric lens 108 may be formed from a resin or a printable dielectric material, for example. As examples, the dielectric lens 108 may be formed of acrylonitrile butadiene styrene (ABS), polylactic acid (PLA), high impact polystyrene, or the like.

A ground plane 112 is secured to a bottom surface 114 of the composite substrate 102. The ground plane 112 is on an opposite surface of the composite substrate 102 from the dielectric lens 108.

The microstrip feed network 106 is electrically connected to a switch 116, such as an RF switch. The switch 116 may include a plurality of switches. An input/output port 118 is electrically connected to the switch 116.

The antenna assembly 100 provides a low-power steerable antenna array. Each antenna element 104 is electrically coupled to the microstrip feed network 106. Each antenna element 104 is selectively activated and deactivated by the switch 116. The hemispherical dome 110 of the dielectric lens 108 is shaped such that far-field electrical plane waves 119 impinging thereon at different angles are refracted within the dielectric lens 108 and focused on the antenna elements 104. As such, the angle of arrival for the plane waves 119 may be controlled via the switch 116. Further, by electrically coupling the antenna elements 104 with the microstrip feed network 106, impedance bandwidth is increased in comparison to inset-fed antenna elements.

As shown, the antenna assembly 100 includes one or more antenna elements 104. The dielectric lens 108 covers the antenna elements 104. The switch 116 is electrically connected to the microstrip feed network 106, and is configured to selectively control the antenna elements 104.

Figure 2:
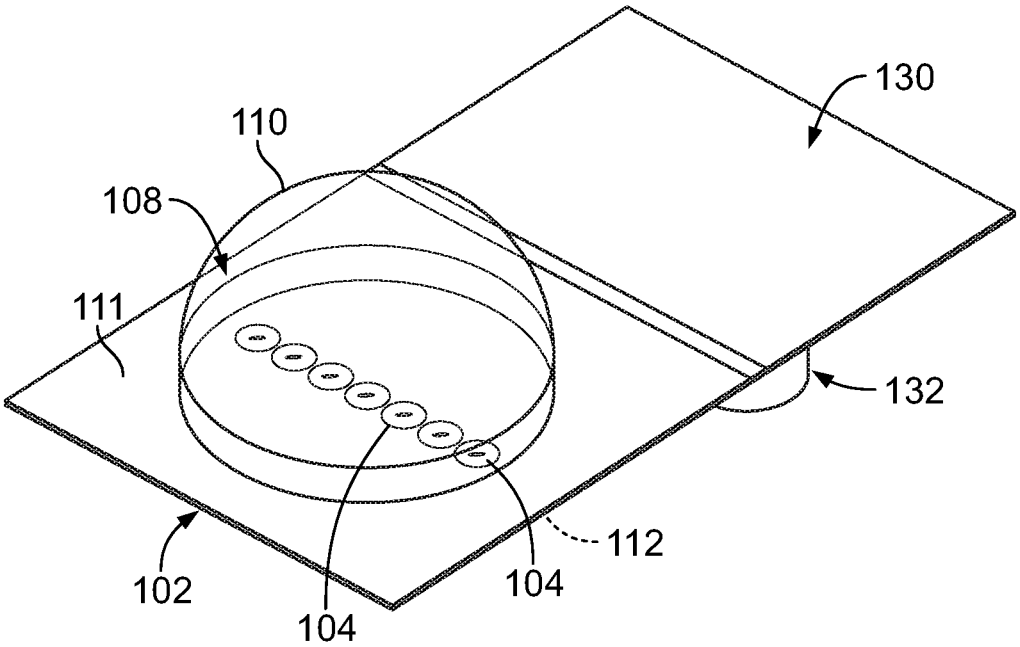
FIG. 2 illustrates a perspective top view of the antenna assembly.
Figure 3:
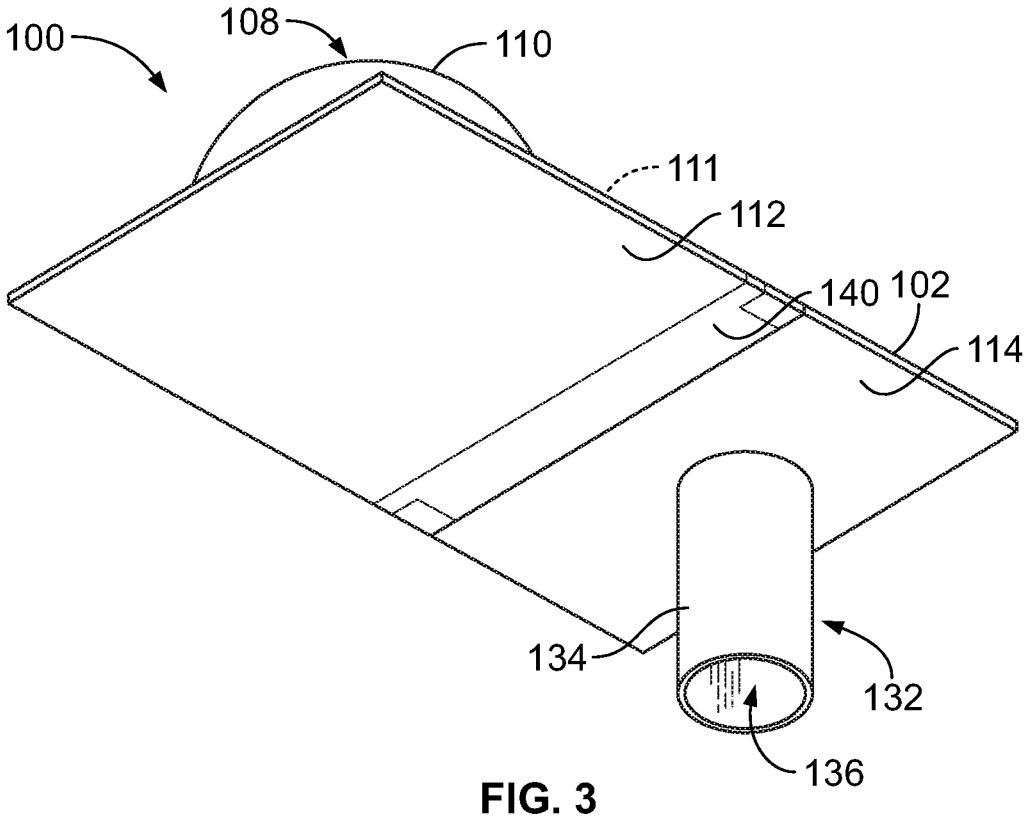
FIG. 3 illustrates a perspective bottom view of the antenna assembly.

FIG. 2 illustrates a perspective top view of the antenna assembly 100. FIG. 3 illustrates a perspective bottom view of the antenna assembly 100. Referring to FIGS. 2 and 3, the dielectric lens 108 is disposed on the top surface 111 of the composite substrate 102 opposite from the ground plane 112, which may be a first or backside ground plane. The hemispherical dome 110 of the dielectric lens 108 is positioned over the antenna elements 104, thereby enclosing the antenna elements 104. As such, energy may be transmitted from the antenna elements 104 through the dielectric lens 108 away from the ground plane 112. Similarly, energy may be received by the antenna elements through the dielectric lens 108.

In at least one embodiment, the antenna assembly may also include a ground plane 130 (such as a second or topside ground) disposed on the top surface 111 of the composite substrate 102 away from the dielectric lens 108. That is, the ground plane 130 may not extend to, within, or below the dielectric lens 108, nor is the ground plane 130 disposed over the antenna elements 104.

A waveguide 132 may be secured to the bottom surface 114 of the composite substrate 102 opposite from the ground plane 130. The waveguide 132 may include a tube 134 defining a central channel 136. The waveguide 132 may be formed of aluminum or another conductive material.

The ground plane 112 is away from the waveguide 132. That is, the ground plane 112 may not extend to, within, or above the waveguide 132.

One or more antenna elements (hidden from view in FIGS. 2 and 3) are disposed on or within the composite substrate 102 between the ground plane 130 and the waveguide 132. Energy may be transmitted from such antenna elements away from the ground plane 112. Similarly, energy may be received by such antenna elements through the waveguide 132.

In at least one embodiment, the waveguide 132 is secured to the bottom surface 114 of the composite substrate 102 opposite from the ground plane 130. One or more second antenna elements 150 (shown in FIG. 4) are disposed on to the bottom surface 114 of the composite substrate 102 within the central channel 136 of the waveguide 132.

In at least one embodiment, an overlap area 140 of the ground plane 112 may be positioned underneath an overlap 142 of the ground plane 130. An internal portion of the composite substrate 102 is sandwiched between the overlap area 140 and the overlap area 142. Alternatively, the antenna assembly 100 may not include the ground plane 112 and/or the ground plane 130.

Figure 4:
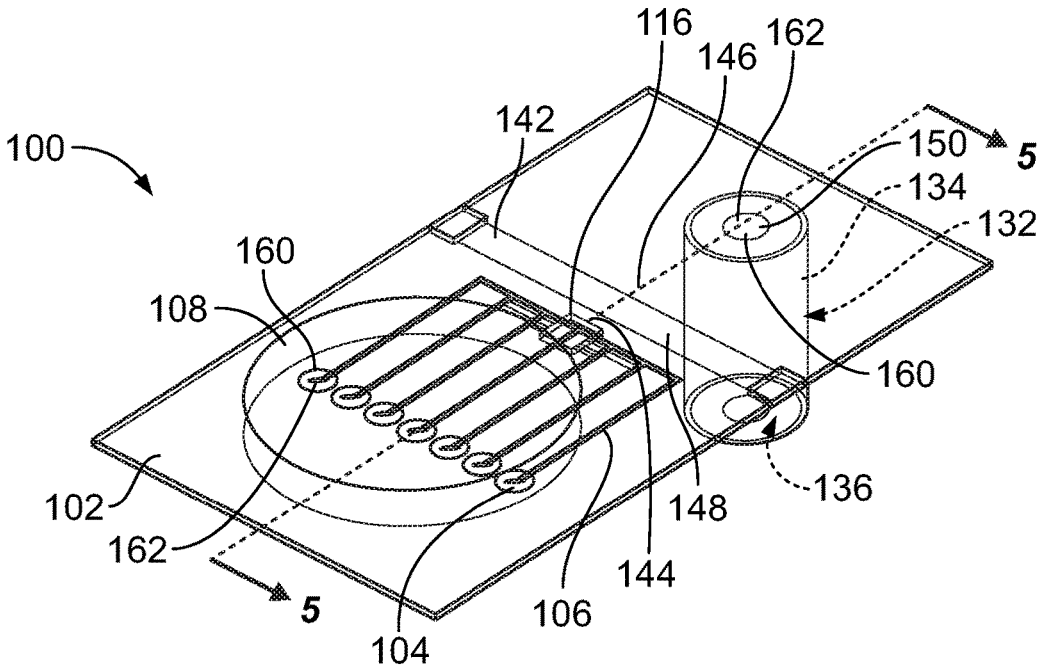
FIG. 4 illustrates a perspective top view of the antenna assembly with portions shown transparent.

FIG. 4 illustrates a perspective top view of the antenna assembly 100 with portions shown transparent. As shown, the antenna elements 104 are electrically coupled to the microstrip feed network 106, which, in turn, electrically connects to the switch 116. The switch 116 is, in turn, electrically connected to a microstrip feed line 144 that connects to another microstrip feed line 146, such as through and/or within a stripline 148. In at least one embodiment, the stripline 148 is defined between the overlap area 140 of the ground plane 112 (shown in FIG. 3) and the overlap area 142 of the ground plane 130 (shown in FIG. 2).

The microstrip feed line 146 is, in turn, electrically coupled to an antenna element 150 disposed on or within the composite substrate 102 underneath the ground plane 130 (shown in FIG. 2). The antenna element 150 is positioned above the waveguide 132. For example, the antenna element 150 may be within the central channel 136 defined by the tube 134 of the waveguide 132.

Referring to FIGS. 1-4, the composite substrate 102 may include a plurality of layers, such as dielectrics, adhesives, and the like. The antenna assembly 100 may include seven or more antenna elements 104 underneath the dielectric lens 108, and one antenna element 150 above the waveguide 132. Optionally, the antenna assembly 100 may include more or less than seven antenna elements 104 underneath the dielectric lens 108, and more than one antenna element 150 above the waveguide 132. Further, the antenna elements 104 and/or the antenna element(s) 150 may be arranged in a linear fashion, as a matrix, or the like. For example, four antenna elements 104 may be arranged in a 2×2 array, sixteen antenna elements 104 may be arranged in a 4×4 array, and/or the like. The arrangement and number of antenna elements 104 and 150 shown in FIGS. 1, 2, and 4 is merely exemplary, and not limiting. The microstrip feed network 106 may include one or more power dividers that are configured to distribute power to the antenna elements.

In at least one embodiment, the antenna elements 104 are disposed on a first dielectric of the composite substrate 102. The microstrip feed network 106 is embedded within the composite substrate 102 underneath the antenna elements 104. In this manner, the antenna elements 104 are proximity-coupled to the microstrip feed network 106. Alternatively, the antenna elements 104 and the microstrip feed network 106 may be on a common layer (such as a common dielectric layer), such that the antenna elements 104 are edge-fed in relation to the microstrip feed network 106.

The antenna elements 104 and 150 may include circular-shaped main bodies 160 with an interior inclusive slot 162 formed therein. The antenna elements 104 and 150 shown are circular, slotted antenna elements. The slot 162 of each antenna element 104 and 150 increases bandwidth and promotes circular polarization. That is, the slot 162 forces current to rotate around the respective antenna elements 104 and 150. Alternatively, the antenna elements 104 and 150 may be sized and shaped differently than shown. For example, the antenna elements 104 and 150 may have a rectangular axial cross section. In at least one other embodiment, at least one of the antenna elements 104 and 150 may not include a slot 162.

Figure 5:
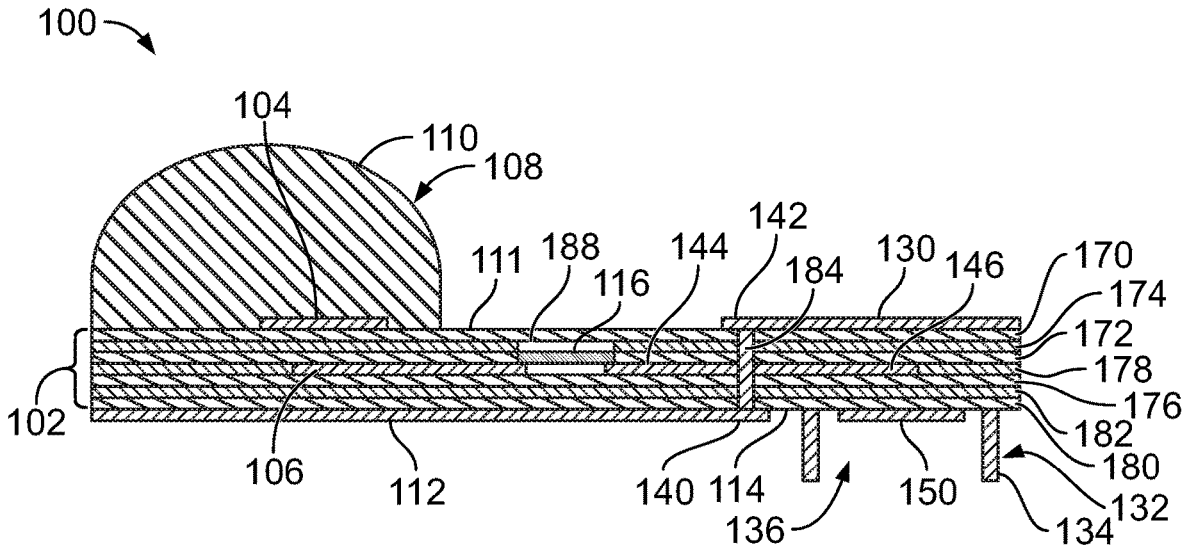
FIG. 5 illustrates a cross-sectional view of the antenna assembly through line 5-5 of FIG. 4, according to an embodiment of the present disclosure.

FIG. 5 illustrates a cross-sectional view of the antenna assembly 100 through line 5-5 of FIG. 4, according to an embodiment of the present disclosure. The composite substrate 102 may be formed through a plurality of layers. The composite substrate 102 may include more or less layers than shown in FIG. 5.

In at least one embodiment, the antenna elements 104 and the ground plane 130 may be formed on a first dielectric 170 of the composite substrate 102, such as through a subtractive process (for example, laser etching, milling, or wet etch), or an additive process (for example, ink printing or film deposition). The composite substrate 102 may also include a second dielectric 172 secured underneath the first dielectric 170 through an adhesive layer 174.

The microstrip feed network 106, the microstrip feed line 144, and the microstrip feed line 146 may be formed on a third dielectric 176 of the composite substrate 102, such as through a subtractive process (for example, laser etching, milling, or wet etch), or an additive process (for example, ink printing or film deposition). The microstrip feed line 144 and the microstrip feed line 146 may form portions of a single microstrip feed line or network. The third dielectric 176 may be secured underneath the second dielectric 172 through an adhesive layer 178.

The ground plane 112 and the antenna element 150 may be formed on the bottom surface 114 of a fourth dielectric 180 of the composite substrate 102, such as through a subtractive process (for example, laser etching, milling, or wet etch), or an additive process (for example, ink printing or film deposition). The fourth dielectric 180 may be secured underneath the third dielectric 176 through an adhesive layer 182.

One or more electrical vias 184 may electrically connect the ground plane 112 to the ground plane 130. The electrical via(s) 184 extend through the composite substrate 102 in the overlap areas 140 and 142.

The switch 116 is attached to the composite substrate 102. For example, the switch 116 is positioned within a cavity 188 of the composite substrate 102 and is disposed over an end of the microstrip feed network 106 and an end of the microstrip feed line 144.

The various layers of the antenna assembly 100 are bonded together, such as through one or more adhesive layers. During assembly, the switch 116 may be secured to the composite substrate 102. After bonding, the dielectric lens 108 may be disposed over the antenna elements 104, such as via printing, and the waveguide 132 may be disposed on the fourth dielectric 180 around and under the antenna element 150.

As shown, the waveguide 132 is secured to the bottom surface 114 of the composite substrate 102 (for example, the bottom surface 114 formed by the fourth dielectric 180) opposite from the ground plane 130. The second antenna element(s) 150 are disposed on to the bottom surface 114 of the composite substrate 102 within the central channel 136 of the waveguide 132.

Figure 6:
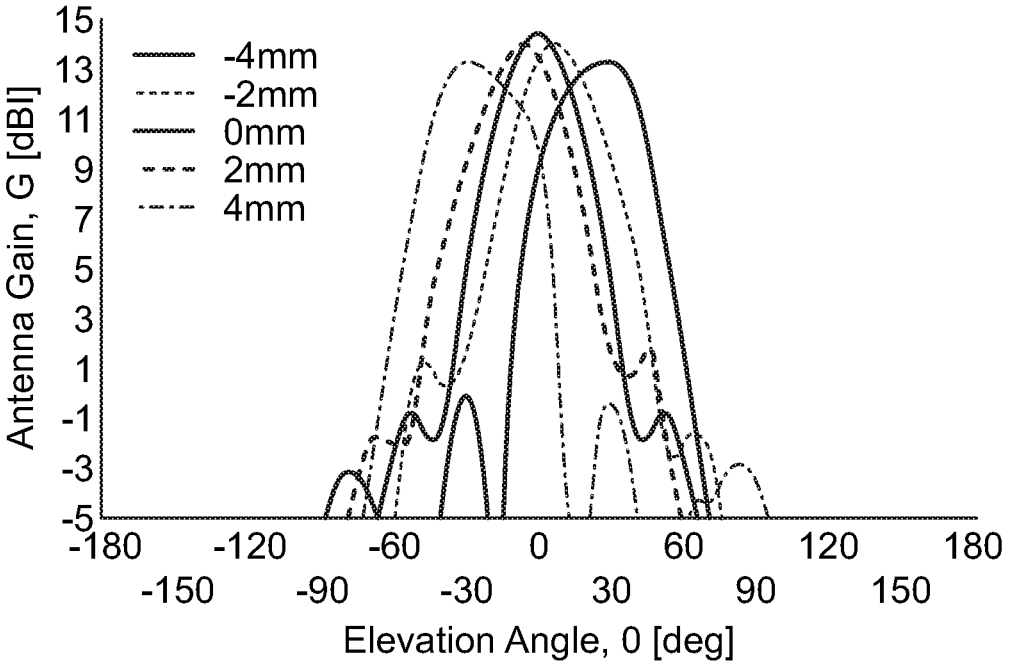
FIG. 6 illustrates a graph of antenna gain in relation to elevation for antenna elements of an antenna assembly, according to an embodiment of the present disclosure.
Figure 7:
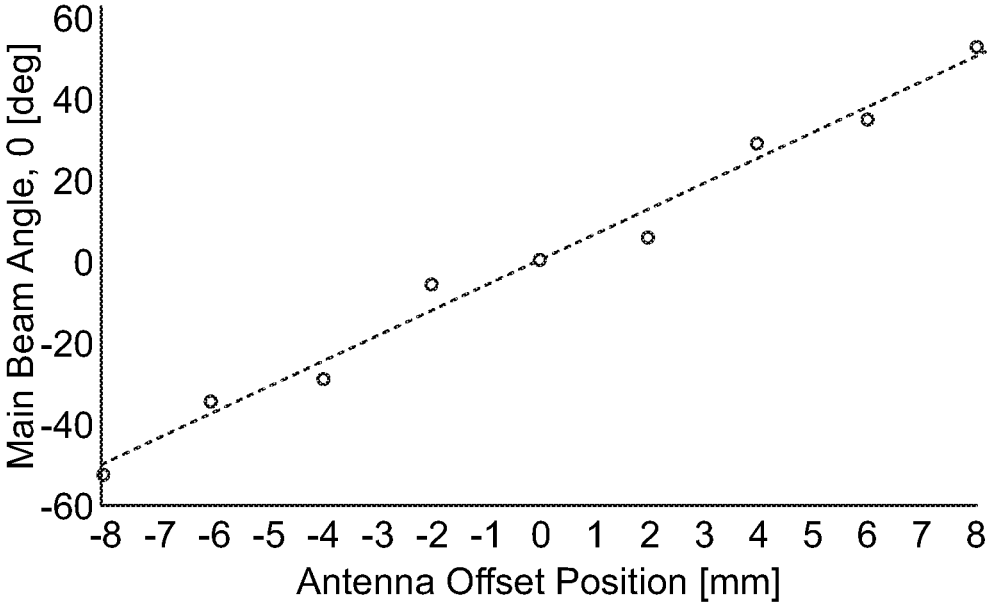
FIG. 7 illustrates a graph of main beam angle in relation to antenna offset position for an antenna assembly, according to an embodiment of the present disclosure.

FIG. 6 illustrates a graph of antenna gain in relation to elevation angle for the antenna elements 104 (shown in FIGS. 1, 2, 4, and 5) of the antenna assembly 100, according to an embodiment of the present disclosure. FIG. 7 illustrates a graph of main beam angle in relation to antenna offset position for an antenna assembly, according to an embodiment of the present disclosure. Referring to FIGS. 6 and 7, a numerical model of an integrated low-power steerable antenna assembly, such as the antenna assembly 100, designed to operate near 20 GHz was developed using a finite element method (FEM) solver to predict the performance thereof. The nominal gain of the antenna assembly with no steering is ~14.7 dBi with a 3 dB beamwidth of ~34 deg. As an example, the antenna assembly is capable of scanning +/− 53 deg by using nine antenna elements 104 (shown in FIGS. 1 and 2, for example) linearly placed with even spacing. The antenna elements 104 are selectively activated by the switch 116 (shown in FIGS. 1 and 4, for example) to direct the main beam.

Figure 8:
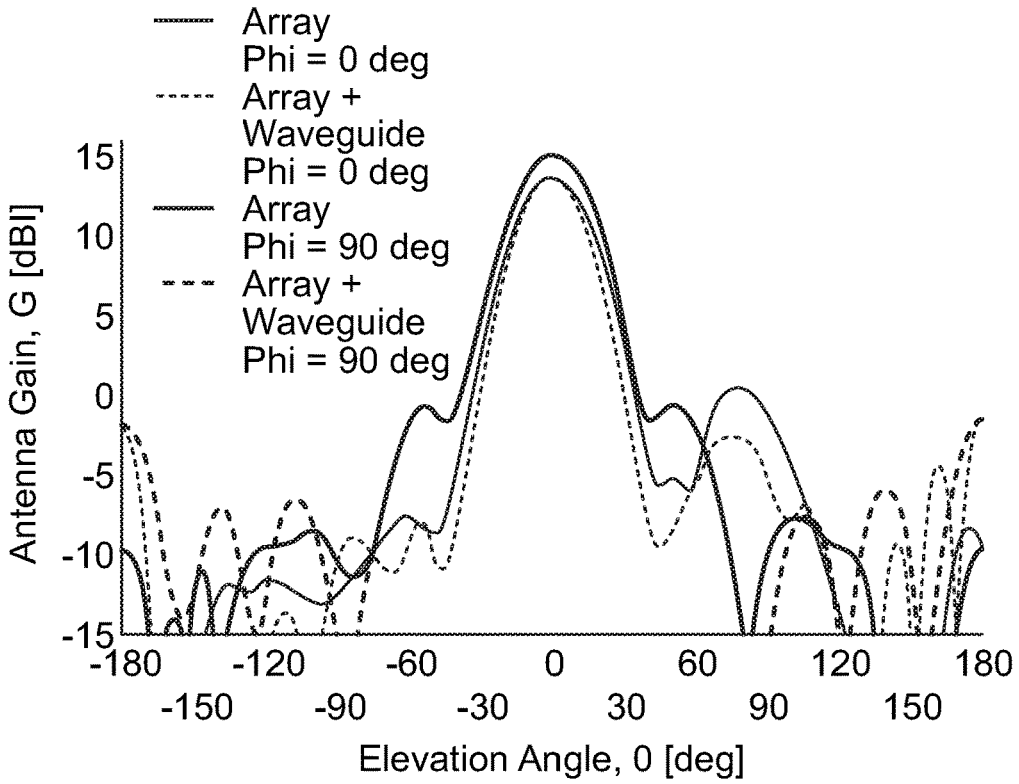
FIG. 8 illustrates a graph of antenna gain in relation to elevation angle for an antenna element of an antenna assembly, according to an embodiment of the present disclosure.

FIG. 8 illustrates a graph of antenna gain in relation to elevation angle for the antenna elements 104 (shown in 1, 2, 4, and 5, for example) of the antenna assembly 100, according to an embodiment of the present disclosure. Referring to FIGS. 4, 5, and 8, the waveguide 132 is electrically coupled to the antenna element 150, which is electrically coupled to an embedded microstrip feed line 146. A numerical model of the antenna assembly 100 at 20 GHz shows the antenna gain of an array without a waveguide is ~1.5 dB higher than an array with a waveguide. The loss in gain is due to the insertion loss of the microstrip-to-waveguide transition.

Figure 9:
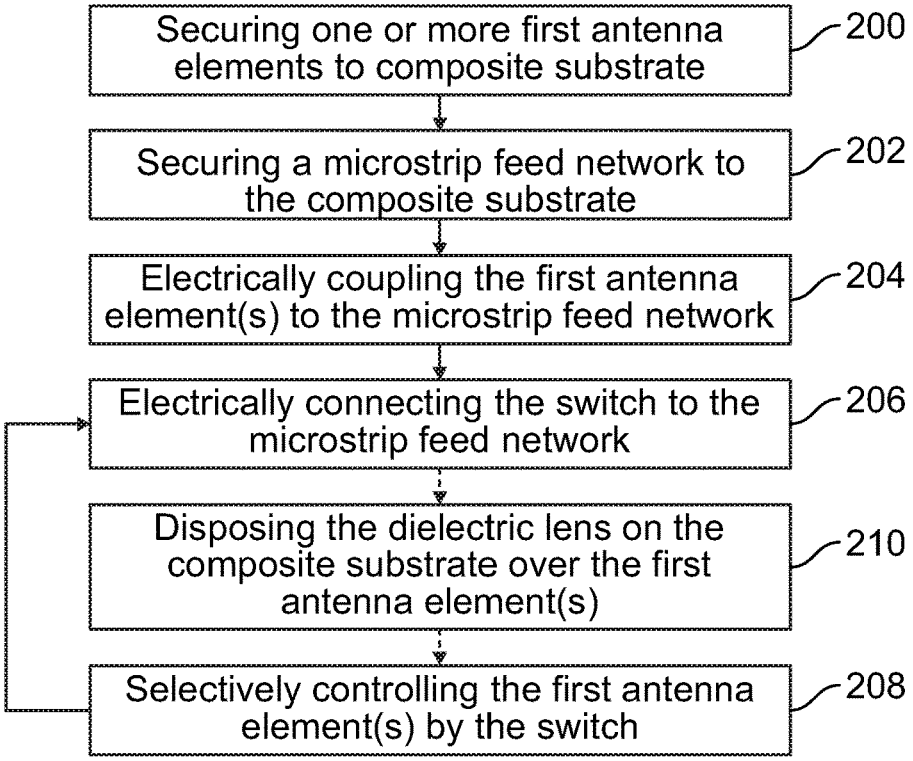
FIG. 9 illustrates a flow chart of an antenna method, according to an embodiment of the present disclosure.

FIG. 9 illustrates a flow chart of an antenna method, according to an embodiment of the present disclosure. Referring to FIGS. 1-5 and 9, the method includes securing (200) one or more first antenna elements 104 to the composite substrate 102, securing (202) the microstrip feed network 106 to the composite substrate 102, electrically coupling (204) the first antenna element(s) 104 to the microstrip feed network 106, electrically connecting (206) the switch 116 to the microstrip feed network 106, and selectively controlling (208) the first antenna element(s) 104 by the switch 116.

In at least one embodiment, the method may also include disposing (210) the dielectric lens 108 on the composite substrate 102 over the first antenna element(s) 104. In at least one embodiment, said disposing includes mounting the hemispherical dome 110 on the top surface 111 of the composite substrate 102 over the first antenna element(s) 104.

In at least one embodiment, said securing the first antenna element(s) 104 includes disposing the first antenna element(s) 104 on the top surface 111 of the composite substrate 102. Further, said securing the microstrip feed network 106 includes embedding the microstrip feed network 106 within the composite substrate 102.

In at least one embodiment, the method further includes securing the first ground plane 112 to the bottom surface 114 of the composite substrate 102 below the first antenna element(s) 104. The method may also include securing a second ground plane 130 secured to the top surface 111 of the composite substrate 102 away from the first antenna element(s) 104.

In at least one embodiment, the method includes securing the waveguide 132 to the bottom surface 114 of the composite substrate 102 opposite from the second ground plane 130. The method may also include disposing one or more second antenna elements 150 on the bottom surface 114 of the composite substrate 102 within the central channel 136 of the waveguide 132. The method may also include electrically coupling the switch 116 to the second antenna element(s) 150 with one or more microstrip feed lines 144 and/or 146.

In at least one embodiment, the method includes disposing the first antenna element(s) 104 on the top surface 111 of the first dielectric 170 of the composite substrate 102, disposing the dielectric lens 108 on the top surface 111 of the first dielectric 170 over the first antenna element(s) 104, providing the second dielectric 172, disposing the microstrip feed network 106 on the third dielectric 176, separating the first dielectric 170 from the third dielectric 176 by the second dielectric 172, disposing the first ground plane 112 on the bottom surface 114 of the fourth dielectric 180 below the first antenna element(s) 104, disposing the second ground plane 130 on the top surface 111 of the first dielectric 170 away from the first antenna element(s) 104, extending one or more electrical vias 184 through the composite substrate 102 to electrically connect the first ground plane 112 to the second ground plane 130, disposing one or more second antenna elements 150 on the bottom surface 114 of the fourth dielectric 180 away from the first ground plane 112 and below the second ground plane 130, and disposing the waveguide 132 on the bottom surface 114 of the fourth dielectric 180, wherein the second antenna element(s) 150 are within the central channel 136 of the waveguide 132.

As described herein, embodiments of the present disclosure provide a steerable antenna assembly that consumes a reduced amount of power. Further, embodiments of the present disclosure provide a steerable antenna assembly that is less costly to produce than known electronically steerable antennas.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. An antenna assembly, comprising:

a composite substrate having a cavity;

one or more first antenna elements secured to the composite substrate;

a microstrip feed network secured to the composite substrate, wherein the one or more first antenna elements are electrically coupled to the microstrip feed network; and a switch positioned within the cavity of the composite substrate, wherein the switch is electrically connected to the microstrip feed network, and wherein the switch is configured to selectively control the one or more first antenna elements.

2. The antenna assembly of claim 1, further comprising a dielectric lens disposed on the composite substrate over the one or more first antenna elements.

3. The antenna assembly of claim 2, wherein the one or more first antenna elements are disposed on a top surface of the composite substrate, wherein the dielectric lens comprises a hemispherical dome mounted on the top surface of the composite substrate over the one or more first antenna elements, and wherein the one or more first antenna elements are enclosed between the dielectric lens and the top surface of the composite substrate.

4. The antenna assembly of claim 1, wherein the one or more first antenna elements are disposed on a top surface of the composite substrate.

5. The antenna assembly of claim 1, wherein the microstrip feed network is embedded within the composite substrate.

6. The antenna assembly of claim 1, further comprising a ground plane secured to a bottom surface of the composite substrate below the one or more first antenna elements.

7. The antenna assembly of claim 1, further comprising a ground plane secured to a top surface of the composite substrate away from the one or more first antenna elements.

8. The antenna assembly of claim 7, further comprising:

a waveguide secured to a bottom surface of the composite substrate opposite from the ground plane; and one or more second antenna elements disposed on the bottom surface of the composite substrate within a central channel of the waveguide.

9. The antenna assembly of claim 8, further comprising one or more microstrip feed lines that electrically couple the one or more second antenna elements to the switch.

10. The antenna assembly of claim 1, wherein the composite substrate comprises:

a first dielectric, wherein the one or more first antenna elements are disposed on a top surface of the first dielectric;

a second dielectric;

a third dielectric, wherein the microstrip feed network is disposed on the third dielectric, and wherein the first dielectric is separated from third dielectric by the second dielectric; and a fourth dielectric.

11. The antenna assembly of claim 10, further comprising:

a dielectric lens disposed on the top surface of the first dielectric over the one or more first antenna elements; and a first ground plane disposed on a bottom surface of the fourth dielectric below the one or more first antenna elements.

12. The antenna assembly of claim 11, further comprising:

a second ground plane disposed on the top surface of the first dielectric away from the one or more first antenna elements;

one or more electrical vias extending through the composite substrate and electrically connecting the first ground plane to the second ground plane;

one or more second antenna elements disposed on the bottom surface of the fourth dielectric away from the first ground plane and below the second ground plane; and a waveguide disposed on the bottom surface of the fourth dielectric, wherein the one or more second antenna elements are within a central channel of the waveguide.

13. A method, comprising:

securing one or more first antenna elements to a composite substrate;

securing a microstrip feed network to the composite substrate;

electrically coupling the one or more first antenna elements to the microstrip feed network;

positioning a switch within a cavity of the composite substrate; and electrically connecting the switch to the microstrip feed network, wherein the switch is configured to selectively control the one or more first antenna elements.

14. The method of claim 13, further comprising disposing a dielectric lens on the composite substrate over the one or more first antenna elements.

15. The method of claim 14, further comprising:

disposing the one or more first antenna elements on a top surface of the composite substrate, wherein said disposing the dielectric lens comprises mounting a hemispherical dome on the top surface of the composite substrate over the one or more first antenna elements; and enclosing the one or more first antenna elements between the dielectric lens and the top surface of the composite substrate.

16. The method of claim 13, wherein said securing the one or more first antenna elements comprises disposing the one or more first antenna elements on a top surface of the composite substrate, and wherein said securing the microstrip feed network comprises embedding the microstrip feed network within the composite substrate.

17. The method of claim 13, further comprising:

securing a first ground plane to a bottom surface of the composite substrate below the one or more first antenna elements; and securing a second ground plane secured to a top surface of the composite substrate away from the one or more first antenna elements.

18. The method of claim 17, further comprising:

securing a waveguide to a bottom surface of the composite substrate opposite from the second ground plane;

disposing one or more second antenna elements on the bottom surface of the composite substrate within a central channel of the waveguide; and electrically coupling the switch to the one or more second antenna elements with one or more microstrip feed lines.

19. The method of claim 13, further comprising:

disposing the one or more first antenna elements on a top surface of a first dielectric of the composite substrate;

disposing a dielectric lens on the top surface of the first dielectric over the one or more first antenna elements;

providing a second dielectric of the composite substrate;

disposing the microstrip feed network on a third dielectric of the composite substrate;

separating the first dielectric from the third dielectric by the second dielectric;

disposing a first ground plane on a bottom surface of a fourth dielectric of the composite substrate below the one or more first antenna elements;

disposing a second ground plane on the top surface of the first dielectric away from the one or more first antenna elements;

extending one or more electrical vias through the composite substrate to electrically connect the first ground plane to the second ground plane;

disposing one or more second antenna elements on the bottom surface of the fourth dielectric away from the first ground plane and below the second ground plane; and disposing a waveguide on the bottom surface of the fourth dielectric, wherein the one or more second antenna elements are within a central channel of the waveguide.

20. An antenna assembly, comprising:

a composite substrate including a first dielectric, a second dielectric, a third dielectric, and a fourth dielectric, wherein a cavity is formed in one of more of the first dielectric, the second dielectric, the third dielectric, or the fourth dielectric;

one or more first antenna elements disposed on a top surface of the first dielectric;

a microstrip feed network embedded within the composite substrate and disposed on the third dielectric, wherein the first dielectric is separated from third dielectric by the second dielectric, wherein the one or more first antenna elements are electrically coupled to the microstrip feed network;

a switch positioned within the cavity, wherein the switch is electrically connected to the microstrip feed network, and wherein the switch is configured to selectively control the one or more first antenna elements;

a dielectric lens disposed on the top surface of the first dielectric over the one or more first antenna element, wherein the dielectric lens includes a hemispherical dome mounted on a top surface over the one or more first antenna elements, and wherein the one or more first antenna elements are enclosed between the dielectric lens and the top surface of the composite substrate;

a first ground plane disposed on a bottom surface of the fourth dielectric below the one or more first antenna elements;

a second ground plane disposed on the top surface of the first dielectric away from the one or more first antenna elements;

one or more electrical vias extending through the composite substrate and electrically connecting the first ground plane to the second ground plane;

one or more second antenna elements disposed on the bottom surface of the fourth dielectric away from the first ground plane and below the second ground plane;

one or more microstrip feed lines that electrically couple the one or more second antenna elements to the switch; and a waveguide disposed on the bottom surface of the fourth dielectric, wherein the one or more second antenna elements are within a central channel of the waveguide.

* * * * *